US007633474B2

(12) United States Patent
Lee

(10) Patent No.: US 7,633,474 B2
(45) Date of Patent: Dec. 15, 2009

(54) LIQUID CRYSTAL DISPLAY AND DRIVING METHOD THEREOF

(75) Inventor: Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/492,421

(22) Filed: Jul. 25, 2006

(65) Prior Publication Data

US 2006/0262070 A1 Nov. 23, 2006

Related U.S. Application Data

(63) Continuation of application No. 10/300,033, filed on Nov. 19, 2002, now Pat. No. 7,142,183.

(30) Foreign Application Priority Data

May 16, 2002 (KR) ..... 2002-27105

(51) Int. Cl.
*G09G 3/36* (2006.01)

(52) U.S. Cl. ..... 345/87; 345/55; 345/100; 345/204

(58) Field of Classification Search ..... 345/87, 345/55, 100, 204
See application file for complete search history.

(56) References Cited

U.S. PATENT DOCUMENTS

| | | | | |
|---|---|---|---|---|
| 5,175,619 | A | 12/1992 | Willis | 358/140 |
| 5,264,835 | A * | 11/1993 | Shaw et al. | 345/694 |
| 5,495,265 | A * | 2/1996 | Hartman et al. | 345/87 |
| 5,914,699 | A | 6/1999 | Imamura | |
| 5,926,162 | A | 7/1999 | Wood et al. | |
| 6,046,633 | A | 4/2000 | Shimizu et al. | 330/51 |
| 6,232,946 | B1 | 5/2001 | Brownlow et al. | |
| 6,333,272 | B1 * | 12/2001 | McMillin et al. | 438/710 |
| 6,633,272 | B1 * | 10/2003 | Kumagawa et al. | 345/98 |
| 6,734,868 | B2 * | 5/2004 | Gornstein et al. | 345/572 |

FOREIGN PATENT DOCUMENTS

| | | |
|---|---|---|
| JP | 07281637 | 10/1995 |
| JP | 09097036 | 4/1997 |
| JP | 10312175 | 11/1998 |
| JP | 2000330501 | 11/2000 |
| JP | 2001117074 | 4/2001 |
| JP | 2002091390 | 3/2002 |
| KR | 1020000061578 | 10/2000 |
| KR | 1020000074549 | 12/2000 |
| KR | 1020010009576 | 2/2001 |

* cited by examiner

*Primary Examiner*—Richard Hjerpe
*Assistant Examiner*—Leonid Shapiro
(74) *Attorney, Agent, or Firm*—Cantor Colburn LLP

(57) ABSTRACT

A dual input mode liquid crystal display having high resolution and employing dynamic capacitance compensation ("DCC") is provided. The liquid crystal display includes a timing controller including a DCC processing unit for applying dynamic capacitance compensation ("DCC") to a part of the pixels, a timing redistribution block for converting a format of the DCC-applied data to a predetermined format for a source driver, and a control signal generating block for generating a control signal for displaying an image. Since the DCC processing unit uses only two frame memories, the DCC may be employed by a dual input mode LCD. In addition, since a clock frequency for data processing in the frame memory of the timing controller is preferably the same as the clock frequency in the timing controller of the dual input mode LCD, thereby preventing the increase of EMI.

17 Claims, 9 Drawing Sheets

LIQUID CRYSTAL DISPLAY AND DRIVING METHOD THEREOF

CROSS REFERENCE TO RELATED APPLICATIONS

This application is a continuation of U.S. patent application Ser. No. 10/300,033, filed on Nov. 19, 2002 now U.S. Pat. No. 7,142,183, which is herein incorporated by reference in its entirety.

BACKGROUND OF THE INVENTION

1. Field of the Invention

The present invention relates to a liquid crystal display, and more particularly to a dual input mode liquid crystal display having high resolution and performing dynamic capacitance compensation ("DCC").

2. Description of the Related Art

Lighter and thinner personal computers or television sets require lighter and thinner display devices. Since flat panel displays such as liquid crystal displays ("LCDs") satisfy such requirements, the LCDs have been developed and put to practical use in a variety of fields instead of cathode ray tubes ("CRTs").

LCDs display desired images by applying an electric field to a liquid crystal layer with dielectric anisotropy between two panels and adjusting the strength of the electric field to control the transmittance of incident light onto the panels.

LCDs are used in notebook computers as well as desktop computers. Computer users desire to see moving pictures by using the computers provided with developed multimedia environments. Thus, it is necessary to improve the response speed of the LCDs.

One exemplary technique for improving the response speed of the LCDs is dynamic capacitance compensation ("DCC"). Now, DCC will be described in detail.

The DCC processes RGB data by comparing gray value for a pixel in a previous frame with gray value for a pixel in a current frame and adding a predetermined value larger than the difference between the gray values to the gray value of the previous frame. A typical duration of one frame is 16.7 msec. Since it takes a time for a liquid crystal material in a pixel to respond to an applied voltage, time delay is inevitable until a desired gray is displayed. The DCC minimizes the time delay by applying a voltage larger than the predetermined voltage for a given gray to the pixel.

FIG. 1 shows an exemplary DCC processing unit of a conventional single input mode LCD. The DCC processing unit is in a timing controller of an LCD and is a part of a data processing block.

A single input mode LCD transmits one data for one clock, while a dual input mode LCD transmits two data for one clock. The dual input mode LCD has an advantage of reducing the clock period by half relative to the single input mode LCD. Accordingly, the dual input mode LCD simultaneously transmits both even and odd image data for one clock.

Referring to FIG. 1, the DCC processing unit includes a DCC block 11, a memory controller 12 and frame memories A and B 13 and 14.

The DCC block 11 receives current frame data from an external graphic source and previous frame data from the frame memory B 14 via the memory controller 12. The DCC block 11 compares the current frame data and the previous frame data and outputs DCC converted data selected from a built-in look-up table ("LUT") based on the result of the comparison. The optimal DCC data for the current frame data and the previous fame data is given in the LUT. The current frame data is stored in the frame memory A 13 under the control of the memory controller 12. As described above, a conventional single input mode LCD performing the DCC requires two frame memories for respectively storing the current frame data and the previous frame data. Typically, LCDs having low resolutions such as VGA or WXGA grade resolution are single input mode LCDs, while LCDs having high resolutions equal to or more than SXGA grade resolution, which has the greater number of data lines and thus requires high clock frequency for data processing, are dual input mode LCDs.

FIG. 2 shows an exemplary DCC processing unit of a conventional dual input mode LCD. The DCC processing unit is in a timing controller of the LCD.

A DCC processing unit shown in FIG. 2 includes two sub-DCC processing units each processing even data or odd data and having substantially the same configuration as the DCC processing unit shown in FIG. 1. A first sub-DCC processing unit includes a DCC block 21, a memory controller 22, a frame memory C 23 and a frame memory D 24, and processes even data of a current frame. A second sub-DCC processing unit includes a DCC block 31, a memory controller 32, a frame memory A 33 and a frame B 34 and processes odd data of the current frame.

As shown in FIG. 2, the dual input mode LCD employing the DCC requires four frame memories 23, 24, 33, and 34 and thus has a problem of the increased number of frame memories. To solve the problem of the increased number of frame memories, it is suggested that the high resolution LCD employs the single input mode while its timing controller increases the data processing clock frequency. However, the high data processing clock frequency causes electromagnetic interference ("EMI"), which enforces to introduce a filter between the timing controller and the frame memory. This increases the area of a printed circuit board for mounting the timing controller thereon as well as a product cost.

SUMMARY OF THE INVENTION

The present invention provides a dual input mode LCD having high resolution in which DCC is performed with the same number of frame memories as a single input mode LCD by applying DCC to a half of all pixels forming a liquid crystal screen without increasing clock frequency for data processing data.

An LCD according to an embodiment of the present invention comprises a liquid crystal panel including a plurality of pixels at intersecting areas of a plurality of gate lines and a plurality of data lines; a gate driver for applying a signal to sequentially scan the gate lines of the liquid crystal panel; a source driver for selecting and outputting a gray voltage to be applied to each of the pixels based on image data; and a timing controller including a DCC processing unit applying dynamic capacitance compensation (referred to as "DCC" hereinafter) to a part of the pixels, a timing redistribution block converting a format of the DCC-applied data to a predetermined format for the source driver, and a control signal generating block for generating a control signal for displaying an image.

According to an exemplary embodiment of the invention, the DCC processing unit using only two memories may be easily implemented in a dual input mode LCD, by applying the DCC processing to only some of a liquid crystal screen, for example, only half of the pixels.

In addition, since a clock frequency for data processing in the frame memory of the timing controller is preferably the same as that provided for the timing controller of the dual input mode LCD, there is no increase of EMI.

According to aspects of the present invention, a variety of pixel arrangements for applying DCC to a half of pixels of the liquid crystal screen are provided.

A more complete appreciation of the invention, and many of the attendant advantages thereof, will be readily apparent as the same becomes better understood by reference to the following detailed description.

DETAILED DESCRIPTION OF PREFERRED EMBODIMENTS

Figure 1:
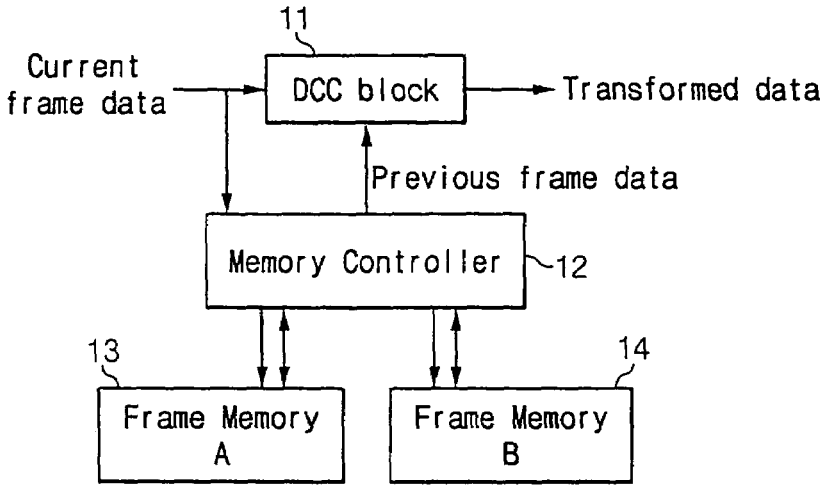
Fig. 1 (Prior Art)
FIG. 1 shows an exemplary conventional single input mode LCD including a DCC processing unit.
Figure 2:
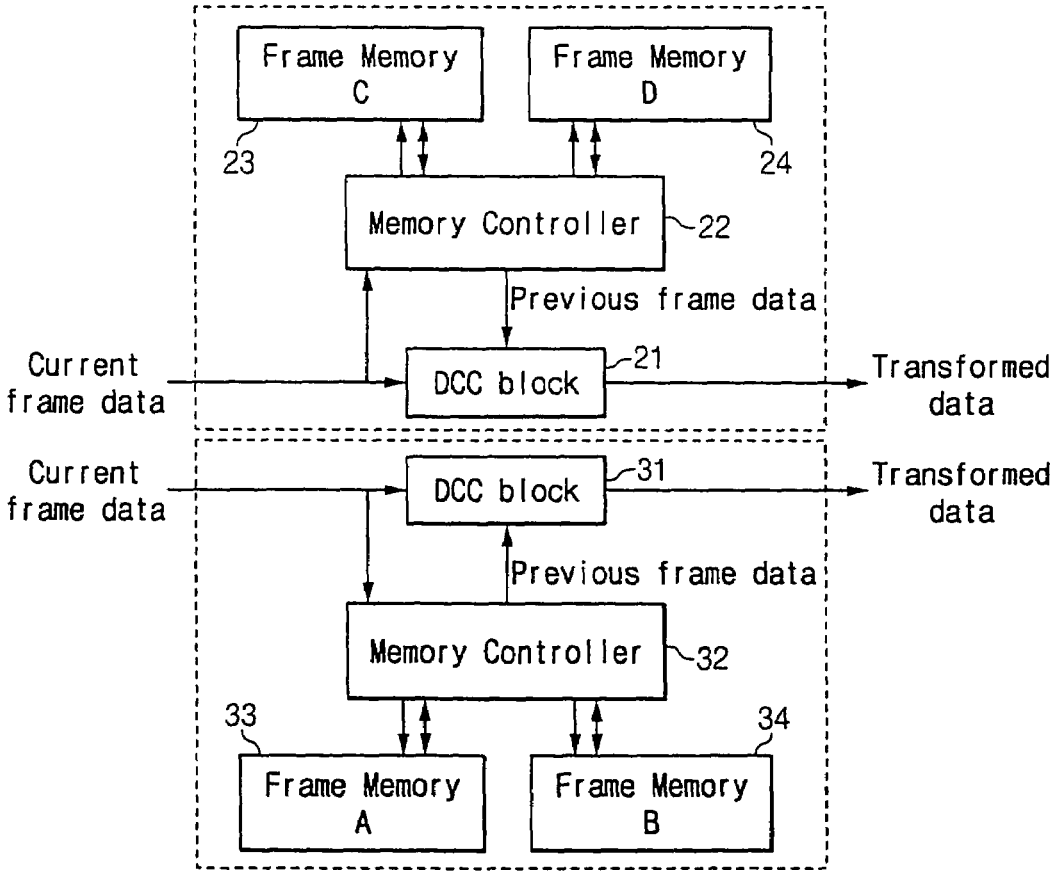
Fig. 2 (Prior Art)
FIG. 2 shows an exemplary conventional single input mode LCD including a DCC processing unit.
Figure 3:
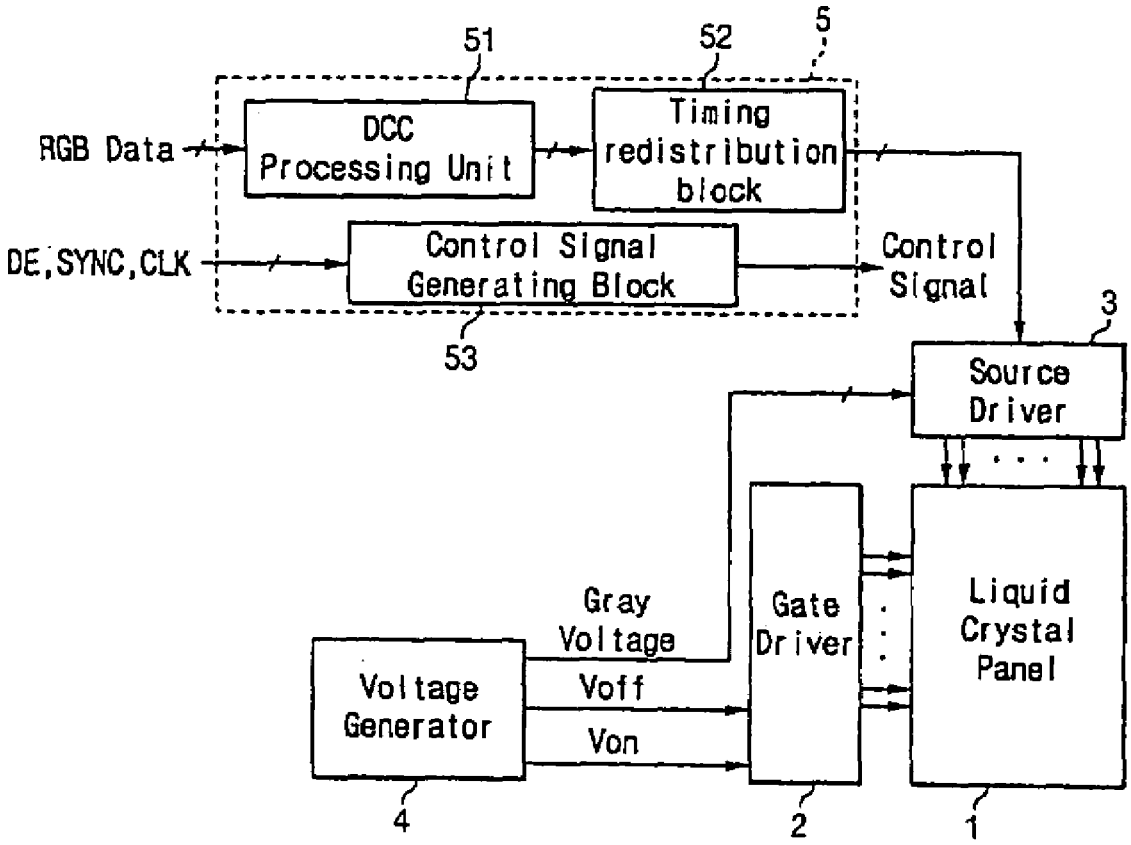
FIG. 3 shows a block diagram of an LCD according to an embodiment of the present invention.

Preferred embodiments of the present invention will be described more in detail hereinafter with reference to the accompanying drawings FIG. 3 shows a block diagram of an LCD according to an embodiment of the present invention.

As shown in FIG. 3, an LCD according to an embodiment of the present invention includes a liquid crystal panel assembly 1, a gate driver 2, a source driver 3, a voltage generator 4 and a timing controller 5.

Although not shown in detail in FIG. 3, the liquid crystal panel assembly 1 includes a plurality of gate lines and a plurality of data lines intersecting each other, and a plurality of pixels provided in intersecting areas of the gate lines and the data lines. The pixels receive analog voltages for displaying images via the data lines upon the sequential scanning of the gate lines.

The timing controller 5 includes a DCC processing unit 51, a timing redistribution block 52 and a control signal generating block 53. The timing controller 5 receives RGB data, a data enable signal DE, a synchronization signal SYNC and a clock signal CLK from an external graphic source. The RGB data is inputted to the DCC processing unit 51 of the timing controller 5 and DCC-transformed therein. The timing redistribution block 52 transforms the DCC-transformed data into a format suitable for the source driver 3 and provides the format-transformed data to the source driver 3. The control signal generating block 53 generates several control signals for controlling display operation of the LCD in response to the data enable signal DE, the synchronization signal SYNC and the clock signal CLK.

The voltage generator 4 generates gate on/off voltages for scanning the gate lines, provides the gate on/off voltages (Von/Voff) to the gate driver 2, and outputs analog voltages to a gray voltage generator (not shown). The source driver 3 selects gray voltages corresponding to the RGB data from the timing controller 5 and applies the gray voltages to the liquid crystal assembly 1.

According to an embodiment of the present invention, the DCC is not performed on all the pixels of the LCD but on a predetermined number of the pixels, e.g., a half of the pixels. The LCD according to the present invention may have many different arrangements of DCC-applied pixels.

Figure 4:
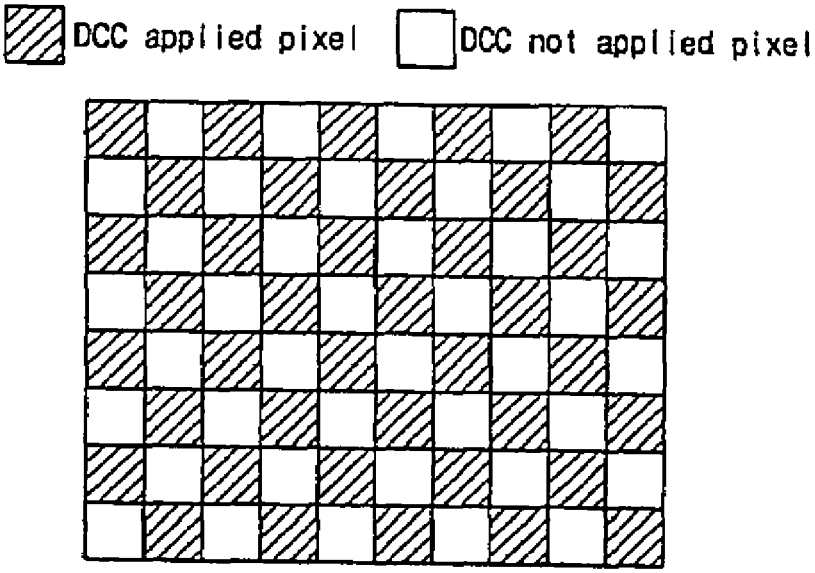
FIG. 4 shows a pixel arrangement according to a first embodiment of the present invention.
Figure 5:
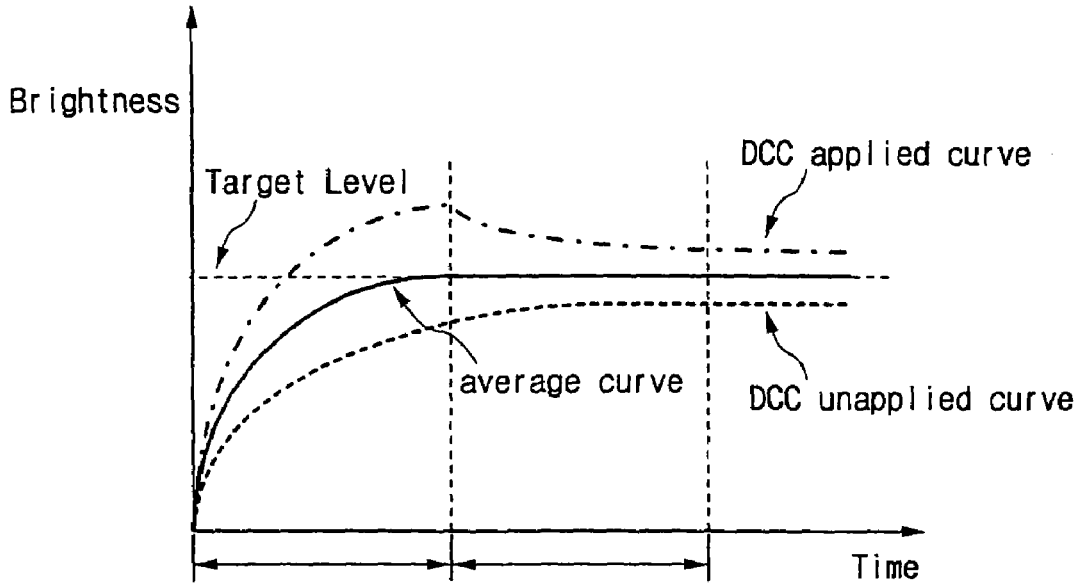
FIG. 5 shows a graph of brightness curves for explaining a principle of the present invention.
Figure 6:
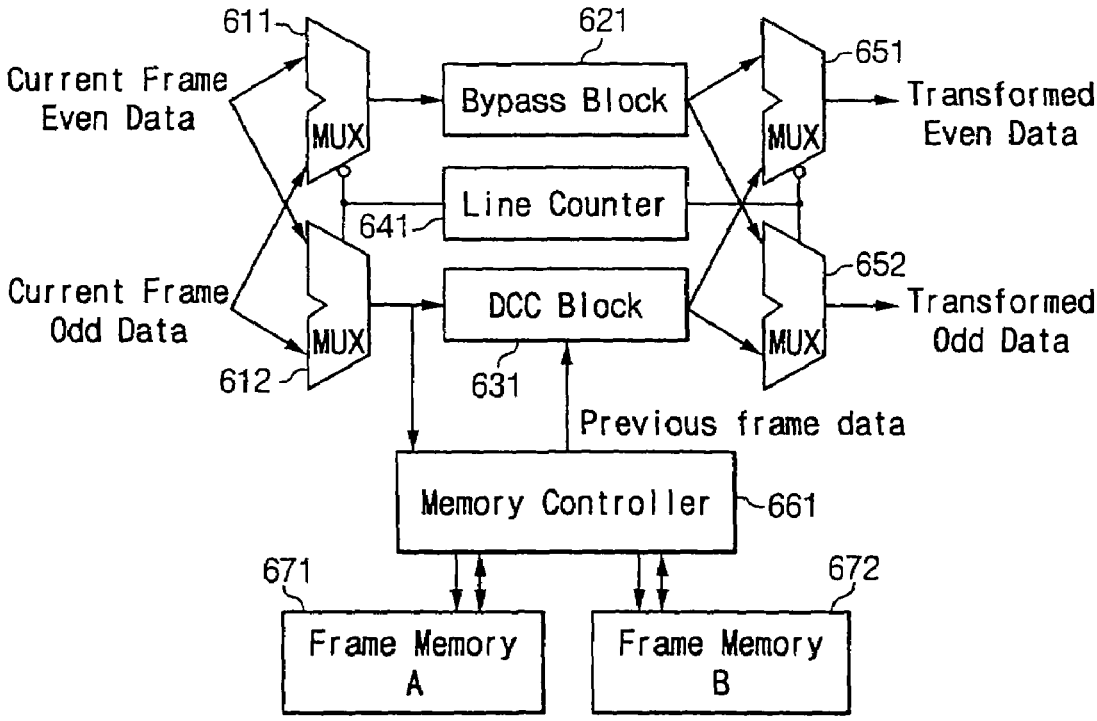
FIG. 6 shows a block diagram of a DCC processing unit of an LCD according to the first embodiment of the present invention.

FIG. 4 shows an arrangement of pixels according to a first embodiment of the present invention, FIG. 5 shows a graph of average brightness of DCC-applied pixels and DCC-unapplied pixels according to an exemplary embodiment of the present invention, and FIG. 6 shows a block diagram of an exemplary DCC processing unit of an LCD according to the first embodiment of the present invention.

Referring to FIG. 4, the LCD according to the first embodiment of the present invention applies DCC to a pixel one by one. In detail, the DCC is applied to only the odd data in odd rows and only the even data in even rows of a pixel arrangement. Accordingly, when the LCD is a dual input mode where odd data and even data among RGB data are simultaneously inputted to a timing controller, the LCD may apply the DCC to one of the odd data and the even data.

Thus, in this embodiment of the present invention, only two frame memories are required even for a dual input mode LCD as well as for a single input mode LCD since the timing controller applies the DCC to one of the odd data and the even data.

Further, the clock frequency for transmitting the RGB data of the frame memories of the timing controller may be equal to the main clock frequency of the LCD.

Further more, the size of the frame memories is reduced by half since the DCC is applied to only half of all the RGB data, which in turn reduces the data to be stored in the frame memories by half.

As shown in FIG. 5, an embodiment of the present invention applies the DCC not to all the pixels (image data) but to only a half of the pixels, and thus displays the image with an average response speed (average curve) of a response speed (DCC applied curve) of DCC-transformed data and a response speed (DCC unapplied curve) of DCC-untransformed data.

A desired level of the average brightness may be adjusted by appropriately selecting values of the DCC-transformed data larger than those in a look-up table for a single input mode LCD employing the DCC. That is, a single input mode LCD obtains substantially the same average curve as that shown in FIG. 5 by applying the DCC to all the pixels, while an embodiment of the present invention can obtain the average curve by properly selecting the values in a look-up table for the application of the DCC although the DCC is applied to only a half of the pixels.

Next, a DCC processing unit of an LCD according to the first embodiment of the present invention will be described with reference to FIG. 6. As described above with reference to FIG. 4, the first embodiment of the present invention applies the DCC to only the odd data in the odd rows and to only the even data in the even rows.

As shown in FIG. 6, a DCC processing unit according to the first embodiment of the present invention includes: a first multiplexer 611 for receiving the odd data or even data of a current frame and outputting the even data or the odd data to a bypass block 621; a second multiplexer 612 for receiving the odd data or even data of the current frame and outputting the even data or odd data to a DCC block 631; third and fourth multiplexers 651 and 652 each receiving the outputs of the bypass block 621 and the DCC block 631 and synthesizing the received data into transformed odd data and transformed even data; a memory controller 661 receiving the output of the second multiplexer 612 and supplying previous frame data to the DCC block 631; frame memories A and B 671 and 672 each connected to the memory controller 661 and storing the DCC-applied current frame data and the DCC-applied previous frame data; and a line counter 641 for controlling the first to fourth multiplexers 611, 612, 651 and 652.

RGB data is inputted to the DCC processing unit. The RGB data includes even data and odd data of a current frame. Hereinafter, the even data refers to the data for even pixels in each pixel row and the odd data refers to the data for odd pixels in each pixel row.

The even data and odd data of the current frame are inputted to each of the first and second multiplexer 611 and 612. The first and second multiplexers 611 and 612 respectively select the even data or the odd data based on an output signal of the line counter 641. The line counter 641 outputs the signal having information about row parity of the RGB data, i.e., providing parity information as to whether the RGB data is associated with an even row or an odd row. As described above, the DCC is applied to only the odd data in the odd row and only the even data in the even row. Therefore, when the RGB data is associated with an odd row, the odd data is inputted to the DCC block 631 and the even data is inputted to the bypass block 621. On the contrary, when the RGB data is associated with an even row, the even data is inputted to the DCC block 631 and the odd data is inputted to the bypass block 621. Among the current frame data, the first multiplexer 611 selects the odd or even data to be inputted to the bypass block 621, while the second multiplexer 612 selects the odd or even data to be inputted to the DCC block 631.

The bypass block 621 temporarily holds the output data of the first multiplexer 611 during the DCC processing of the output data of the second multiplexer 612 in the DCC block 631. The data from the second multiplexer 612 is not only inputted to the DCC block 631 but also stored in the frame memory A 671 via the memory controller 661. At the same time, the DCC-applied data of the previous frame stored in the frame memory B 672 is sent to the DCC block 631 under the control of the memory controller 661. The data stored in the frame memory A 671 is moved to the frame memory B 672 by the memory controller 661 for every frame. The DCC block 631 receives the current frame data and the previous frame data to perform the DCC processing of the current frame data and the previous frame data. DCC-transformed values are predetermined values for maximizing the response speed of the liquid crystal based on the current frame data and the previous frame data.

The third multiplexer 651 connected to the bypass block 621 and the DCC block 631 rearranges the DCC-applied data and the bypassed data into even data and odd data. For example, when the RGB data is associated with the first row of the pixel arrangement of FIG. 4, the odd data of the current frame is DCC-transformed by the DCC block 631 and the even data of the current frame is held in the bypass block 621 during a predetermined time. After receiving the outputs of the DCC block 631 and the bypass block 621, the third multiplexer 651 selects the output of the bypass block 621 to output it as the transformed even data. On the contrary, the fourth multiplexer 652 receives the outputs of the DCC block 631 and the bypass block 621 and selects the output of the DCC block 631 to output it as the transformed odd data. Which multiplexer 651 or 652 is selected depends on the row parity information of the output signal of the line counter 641. In the second row of the pixel arrangement shown in FIG. 4, even data is DCC-transformed by the DCC block 631 and odd data is held in the bypass block 621 during a predetermined time. The third multiplexer 651 selects and outputs the output of the DCC block 631 as the transformed even data, and the fourth multiplexer 652 selects and outputs the output of the bypass block 621 as the transformed odd data.

As a result, the DCC processing unit according to the first embodiment applies the DCC to only a half of all the image data. Thus, the DCC using two frame memories may be applied to the dual input mode LCD with resolution equal to or more than SXGA. Since the DCC processing unit according to the first embodiment uses clock frequency equal to that of the single input mode, the increase of EMI is prevented. The above technical feature may be implemented by simple configuration of multiplexers, a line counter and a bypass block.

Next, a DCC processing unit according to a second embodiment of the present invention will be described with reference to FIGS. 7 and 8.

Figure 7A:
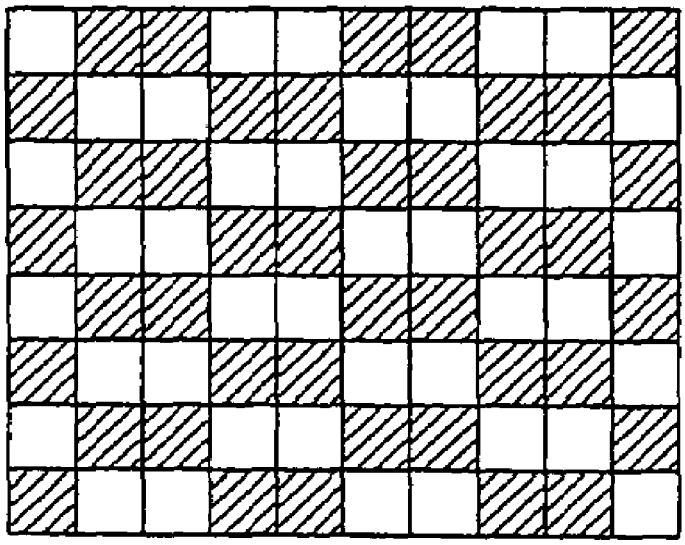
FIGS. 7A and 7B show pixel arrangements according to a second embodiment of the present invention, respectively.
Figure 7B:
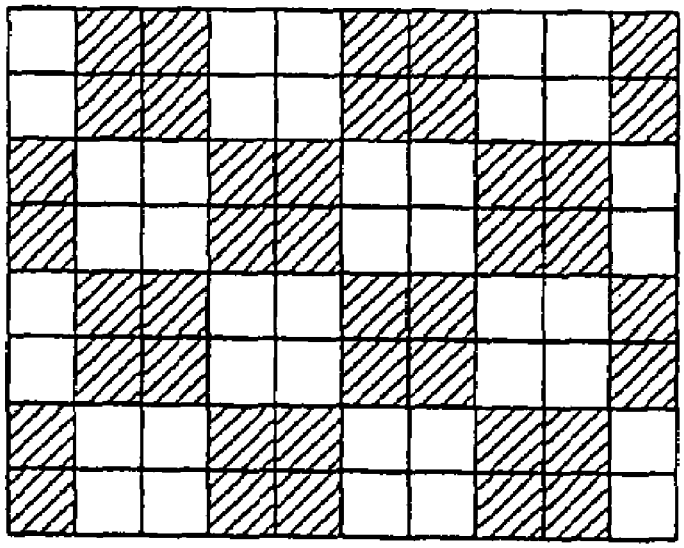
Figure 8:
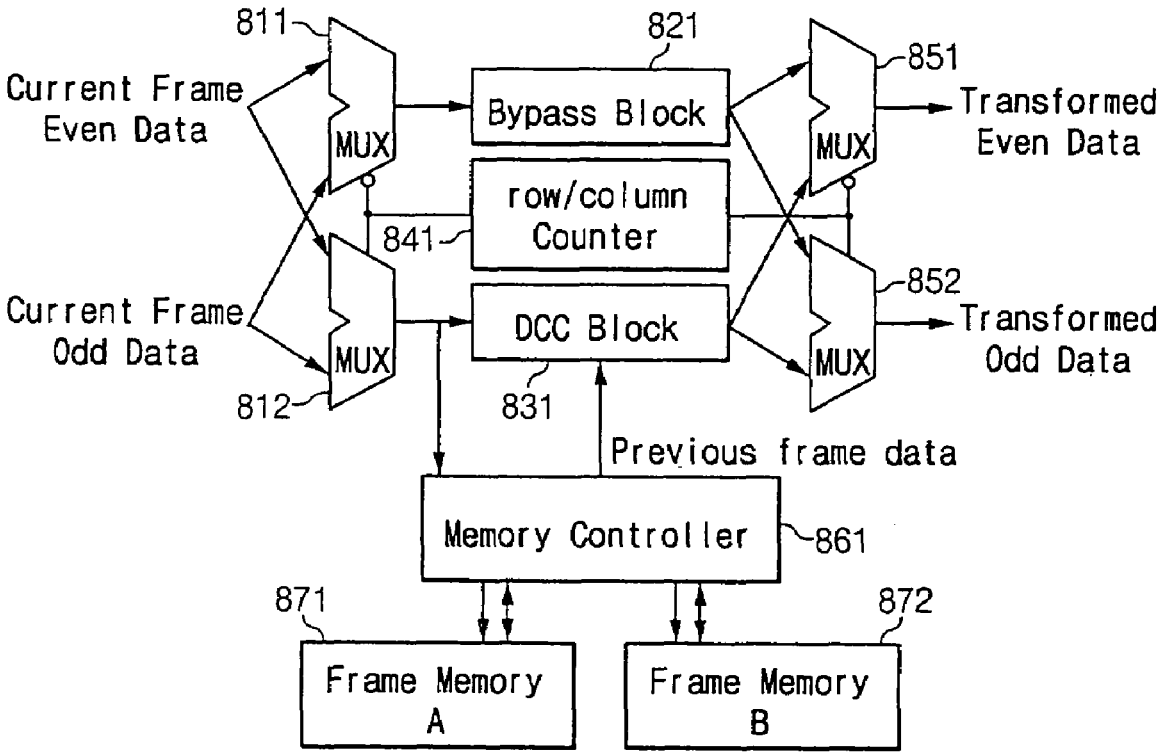
FIG. 8 shows a block diagram of a DCC processing unit of an LCD according to the second embodiment of the present invention.

FIGS. 7A and 7B show arrangements of pixels according to a second embodiment of the present invention, and FIG. 8 shows a block diagram of an exemplary DCC processing unit of an LCD according to the second embodiment of the present invention.

Referring to FIG. 7A, the second embodiment of the present invention applies the DCC two by one group of pixels. For example, the DCC is applied to only the even data in a pair of pixels (e.g., two adjacent pixels) for a first row while it is applied to only the odd data in a pair of pixels for a second row. It is apparent that it can be also applied vice versa. In the second embodiment of the present invention, even data and odd data are alternately selected in pairs of pixels, and, when the row is altered, the order of selection is also altered. It can be seen that the DCC is applied to a half of all the pixels.

FIG. 7B shows the application of the DCC two by two group of pixels. It is apparent to those skilled in the art to alter the number of the rows having the same selection rule by the simple design alteration.

A DCC processing unit according to the second embodiment of the present invention is shown in FIG. 8.

Referring to FIG. 8, a DCC processing unit according to the second embodiment of the present invention is different from that of the first embodiment in that it has a row/column counter 841 instead of the line counter 641. The row/column counter 841 detects the ordinals of the corresponding row and the corresponding column of the current frame data, and one of first to fourth multiplexers 811, 812, 851 and 852 is selected based on an output signal of the row/column counter 841. The output signal of the row/column counter 841 has count information.

For example, in the pixel arrangement shown in FIG. 7A, the row/column counter 841 counts every row and every pair of pixels (e.g., two consecutive pixels) in every row. The first and second multiplexers 811 and 812 alternately select odd data or even data for every pair in response to the output signal of the row/column counter 841 to alternately distribute the even and odd data for two consecutive pixels to a bypass block 821 and a DCC block 831.

For instance, based on the output signal (that has count information for the first two pixels shown in FIG. 7A) of the row/column counter 841, the odd data is selected by the first multiplexer 811 and transmitted to the bypass block 821, while the even data is selected by the second multiplexer 812 and transmitted to the DCC block 831. For the next two pixels, the odd data is selected by the second multiplexer 812 and sent to the DCC block 831, while the even data is selected by the first multiplexer 811 and sent to the bypass block 821. The third and fourth multiplexers 851 and 852 each select one of the outputs of the bypass block 821 and the DCC block 831 in response to the output signal of the row/column counter 841 to reconfigure the frame data. As for the above-described pixel arrangement shown in FIG. 7A, the odd datum for the first two pixels is processed by the bypass block 821 and the even data for the first two pixels is processed by the DCC block 831. Therefore, based on the count information of the row/column counter, the third multiplexer 851 selects and outputs the output of the DCC block 831 as transformed even data, and the fourth multiplexer 852 selects and outputs the output of the bypass block 821 as transformed odd data.

The pixel arrangement shown in FIG. 7B may be implemented by applying the DCC to every two rows for the pixel arrangement shown in FIG. 7A. Therefore, the row/column counter 841 of the DCC processing unit shown in FIG. 8 counts every two rows, and one of the first to fourth multiplexers 811, 812, 851 and 852 is selected based on the information of the row/column counter 841.

The other components of the DCC processing unit shown in FIG. 8 have substantially the same functions and interconnecting relations as those of the DCC processing unit according to the first embodiment.

The above-described second embodiment provides another example of applying the DCC to a half of all pixels.

Next, a DCC processing unit according to a third embodiment of the present invention will be described with reference to FIGS. 9 to 12.

Figure 9A:
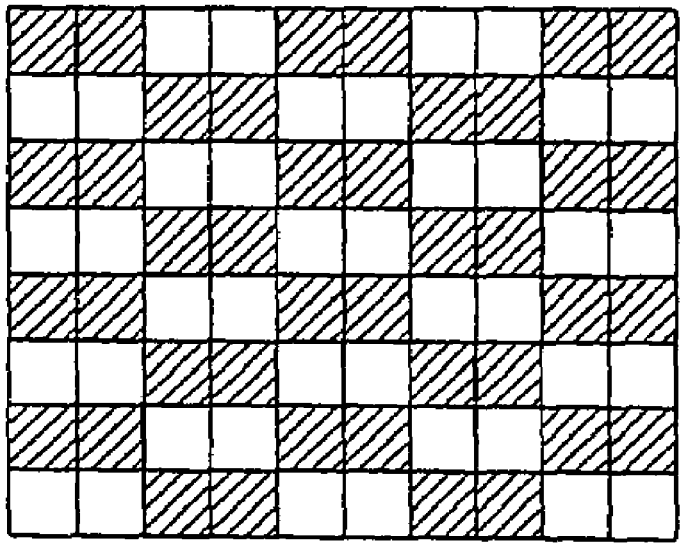
FIGS. 9A and 9B show pixel arrangements according to a third embodiment of the present invention, respectively.
Figure 9B:
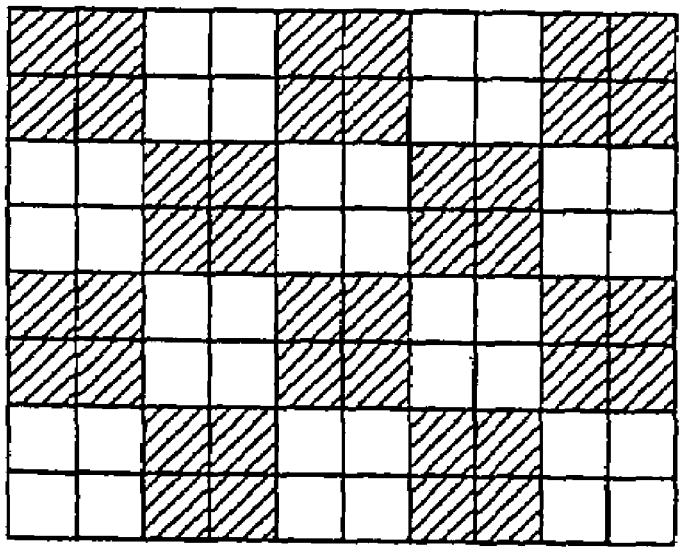
Figure 10:
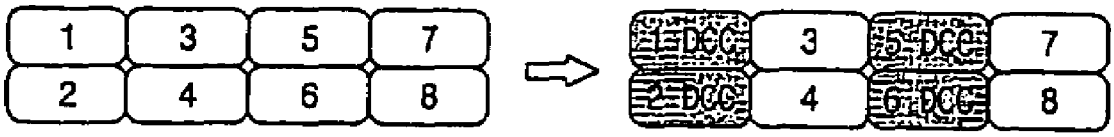
FIGS. 10 and 11 each show DCC processing of data in an LCD according to the third embodiment of the present invention.
Figure 11:
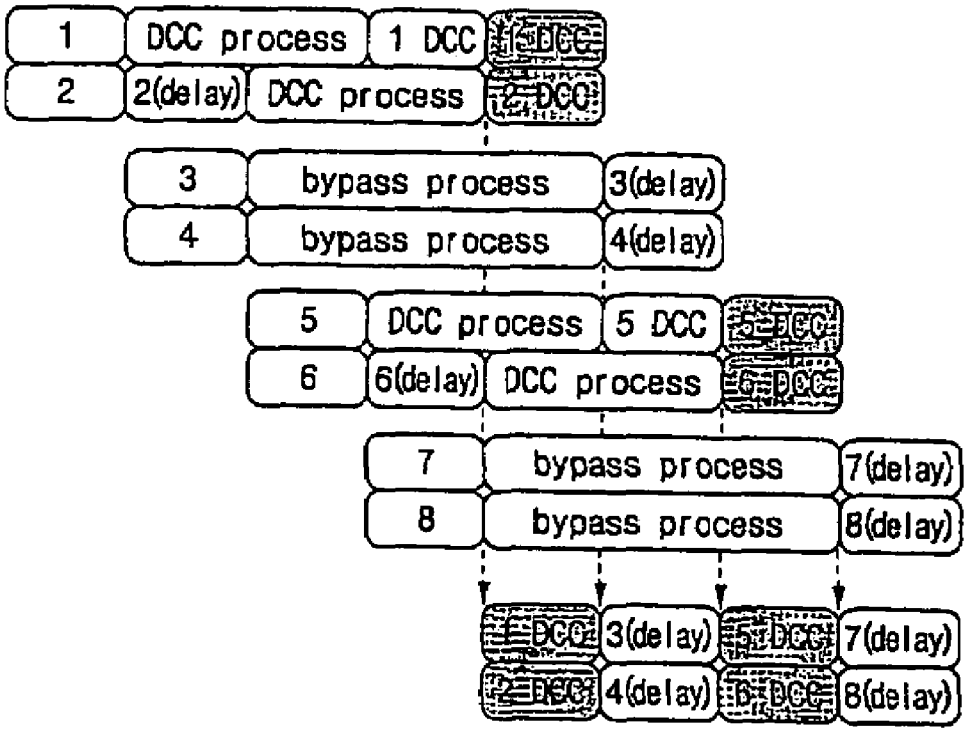
Figure 12:
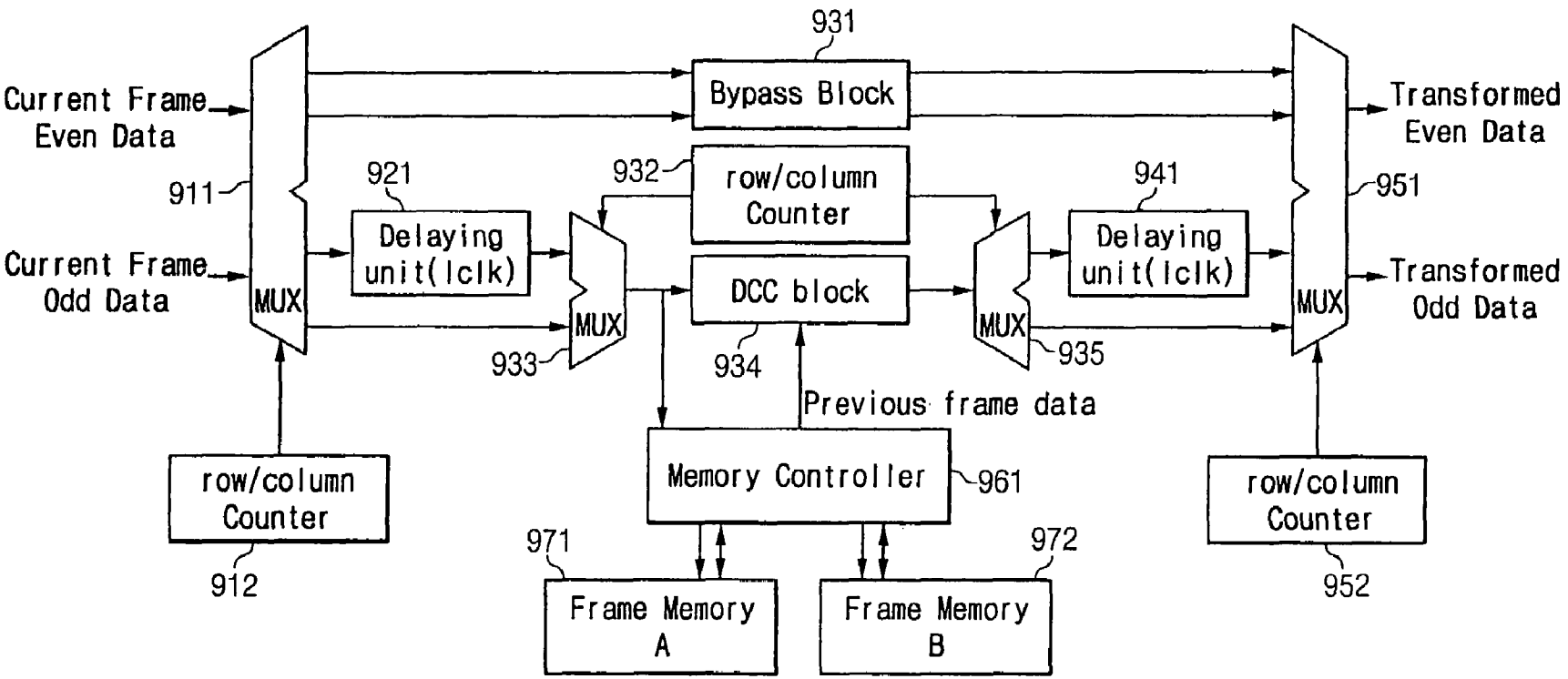
FIG. 12 shows a block diagram of a DCC processing unit of an LCD according to the third embodiment of the present invention.

FIGS. 9A and 9B show pixel arrangements according to a third embodiment of the present invention, FIGS. 10 and 11 show DCC processing of data according to the third embodiment, and FIG. 12 shows a block diagram of an exemplary DCC processing unit according to the third embodiment of the present invention.

The third embodiment of the present invention applies the DCC to alternative pair of pixels (e.g., two consecutive pixels). As described above, the present invention relates to a dual input mode LCD with a high resolution equal to or higher than SXGA degree, and applies the DCC to even and odd data simultaneously. Since the DCC is repeatedly applied to alternate pixel pairs, once first pair of pixels (e.g., first two adjacent pixels) is DCC-transformed, a second pair of pixels (e.g., next two adjacent pixels) is not DCC-transformed. Therefore, the third embodiment of the present invention delays the DCC processing of one of the two pixel data, and performs the DCC processing of the delayed pixel data during the input of the pixel data for the next two pixels (which are not subject to the DCC).

A pixel arrangement shown in FIG. 9A represents that the DCC is applied to alternate pairs of pixels and to alternate pixel rows. For example, the DCC is applied to the first two pixels in the first row, while not applied to the first two pixels in the next row. A pixel arrangement shown in FIG. 9B represents that the DCC is applied to alternate pairs of rows (e.g., two consecutive rows).

FIG. 10 shows the relation between input data and output data for the first row shown in FIG. 9A. The numerals shown in FIG. 10 refer to the ordinals of the pixels. Referring to FIG. 10, the DCC is applied to the first, the second, the fifth, and the sixth input data. FIG. 11 shows a data processing procedure for obtaining the output data shown in FIG. 10. In FIG. 11, it is assumed that the DCC processing is performed for two clocks.

Referring to FIG. 11, the DCC is applied to the data for the first and the second pixels inputted simultaneously in the DCC processing unit. The DCC is applied to the data for the first pixel, and the data for the second pixel is DCC-transformed after delay of one clock. This is possible since the DCC is not applied to the data for the third and the fourth pixels. The processing procedure of the data for the first and the second pixels is equally applied to the data for the fifth and the sixth pixels.

FIG. 12 shows a block diagram of a DCC processing unit according to the third embodiment of the present invention.

As shown in FIG. 12, the DCC processing unit according to the third embodiment of the present invention basically includes a bypass block 931, a DCC block 934, a memory controller 961 and two frame memories A and B 971 and 972.

A first multiplexer 911 is provided at input side of the DCC processing unit, and distributes a pair of pixel (even and odd data) to one of the bypass block 931 and the DCC block 934. A first row/column counter 912 provides row/column count information of a pair of pixels for the first multiplexer 911 to select one of the even and odd data. A second multiplexer 951 is provided at output side of the DCC processing unit, and reconfigures the outputs of the bypass block 931 and the DCC block 934 as transformed even data and odd data. A second row/column counter 952 provides row/column count information of a pair of pixels to control the pixel pair selection of the second multiplexer 951. The DCC according to the third embodiment is alternatively performed on rows in a pixel arrangement like that in the pixel arrangement shown in FIG. 9A, and the DCC is alternatively performed on pairs on adjacent two rows in the pixel arrangement like that in the pixel arrangement shown in FIG. 9B. The change of the alternation unit of one row or two rows can be easily implemented by altering internal settings of the first and second row/column counters 912 and 952.

Meanwhile, the even and odd data of the first multiplexer 911 is inputted to the DCC block 934 via the third multiplexer 933. The even or odd data of the first multiplexer 911 is inputted to the third multiplexer 933 after delayed for one clock by a first delaying unit 921 or without delay. The third multiplexer 933 outputs the even or odd data of the first multiplexer 911 that is not delayed to the DCC block 934 based on the row/column count information from the third row/column counter 932, and outputs one-clock-delayed even or odd data of the first multiplexer 911 to the DCC block 934. The third row/column counter 932 provides the row/column count information for determining which pixel data is first DCC-transformed. First DCC-applied pixel data is outputted from the DCC block 934 and delayed for one clock by a second delaying unit 941. A fourth multiplexer 935 selects the first DCC-applied pixel data to provide it for the delaying unit 941. The other components other than described above have substantially the same configurations and operations as those according to the first embodiment.

Next, a fourth embodiment of the present invention will be described with reference to FIG. 13.

Figure 13A:
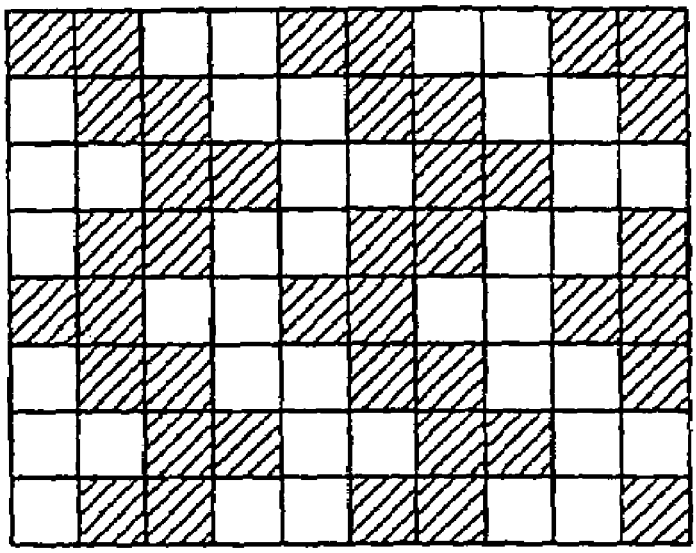
FIGS. 13A and 13B show pixel arrangements according to a fourth embodiment of the present invention.
Figure 13B:
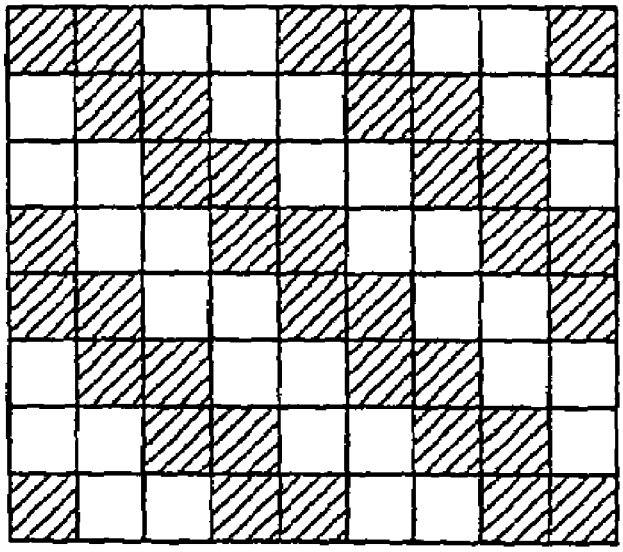

FIGS. 13A and 13B show pixel arrangements according to a fourth embodiment of the present invention. The pixel arrangements of the fourth embodiment are hybrids of the pixel arrangements according the second and the third embodiments. A DCC processing unit for applying the DCC to the pixel arrangements according to the fourth embodiment shown in FIG. 13 can be easily obtained by slightly altering the internal hardware of the DCC processing unit according to the third embodiment shown in FIG. 12.

Referring to FIG. 13A, a certain number of pixels of the three or more consecutive pixels in a column are not DCC-transformed. If the number of the DCC-unapplied pixels in a group of consecutive pixels increases, the groups of consecutive pixels are seen as a stripe. Therefore, it is advantageous to visibility to limit the number of the pixels in the group to equal to or less than four.

As described above, by applying the DCC to only a half of all the image data, the DCC using two frame memories may be properly applied to a dual input mode LCD in resolution equal to or more than SXGA degree. In addition, since clock frequency used in a single input mode LCD may be equally used in a dual input mode LCD, a LCD according to the invention does not need additional components between the timing controller and the frame memories. The above technical feature can be implemented by simple configuration of multiplexers, a line counter and a bypass block.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A liquid crystal display comprising:

a liquid crystal panel including a plurality of pixels at intersecting areas of a plurality of gate lines and a plurality of data lines;

a gate driver for applying a signal to sequentially scan the gate lines of the liquid crystal panel;

a source driver for selecting and outputting a gray voltage to be applied to each of the pixels based on image data; and a timing controller including a DCC processing unit for applying dynamic capacitance compensation ("DCC") to only some of all the pixels in a pixel row by comparing gray values for the pixels in a previous frame with gray values for the pixels in a current frame, a timing redistribution block for converting a format of the DCC-applied data to a predetermined format for the source driver, and a control signal generating block for generating a control signal for displaying an image.

2. The liquid crystal display of claim 1, wherein the pixels are arranged in rows and columns at the intersecting areas of the gate lines and data lines, and wherein the DCC processing unit applies the DCC to odd data for odd pixels in odd rows of the rows and to even data for even pixels in even rows of the rows.

3. The liquid crystal display of claim 1, wherein the pixels are arranged in rows and columns at the intersecting areas of the gate lines and data lines, and wherein the DCC processing unit applies the DCC to even data for even pixels in odd rows of the rows and to odd data for odd pixels in even rows of the rows.

4. The liquid crystal display of claim 1, wherein the pixels are arranged in rows and columns at the intersecting areas of the gate lines and data lines, and wherein the DCC processing unit applies the DCC to one pixel data in a pair of two consecutive pixels in each row, a parity of DCC-transforming pixel data is different from each other in consecutive pixel pairs, and the parity of the DCC transforming pixel data is different from each other in consecutive columns.

5. The liquid crystal display of claim 4, wherein the DCC processing unit comprises:

a distributor for receiving the pixel pairs of a current frame and for distributing DCC-transforming pixel data of the pixel pairs to a DCC block and DCC-untransforming pixel data to a bypass block, based on row/column ordinal information of the pixel pairs;

the DCC block DCC for transforming the DCC-transforming pixel data of the current frame by comparing the gray value of the pixel data of the current frame with the gray value of previous frame data;

the bypass block for delaying the DCC-untransforming pixel data during the DCC transformation of the DCC-transforming pixel data in the DCC block;

a synthesizer for selecting one of outputs of the DCC block and the bypass block, based on the row/column ordinal information of the pixel pairs to output the selected one as transformed even data or transformed odd data;

a row/column counter for counting ordinals of the rows and the columns to provide the row/column ordinal information to the distributor and the synthesizer;

first and second frame memories storing the current frame data and the previous frame data, respectively; and a memory controller for storing the DCC-transforming pixel data from the DCC block in the first frame memory as the current frame data, and transmitting the previous frame data stored in the second frame memory to the DCC block.

6. The liquid crystal display of claim 5, wherein the row/column counter counts every one or more rows of the pixel arrangement.

7. The liquid crystal display of claim 6, wherein the distributor comprises first and second multiplexers for selecting the DCC-transforming pixel data of the pixel pairs based on the row/column ordinal information of the row/column counter, and the synthesizer comprises third and fourth multiplexers for selecting one of the outputs of the DCC block and the bypass block based on the row/column ordinal information of the row/column counter.

8. The liquid crystal display of claim 1, wherein the pixels are arranged in rows and columns at the intersecting areas of the gate lines and data lines, and wherein the DCC processing unit alternatively applies the DCC to pairs of two consecutive pixels such that a pattern of DCC-applied pixel pairs is changed by one row.

9. The liquid crystal display of claim 8, wherein the DCC processing unit applies the DCC to the pixel pairs such that first pixel data of a first pair of two consecutive pixels is delayed during application of the DCC to second pixel data of the first pair of pixels, and the second pixel data of the first pair of pixels is DCC-transformed during bypassing a second pair of next two consecutive pixels.

10. The liquid crystal display of claim 9, wherein the DCC processing unit comprises:

a distribute for receiving the pairs of pixels, and outputting the first pixel data of the first pair of the consecutive pixels to a DCC block, the second pixel data of the first pair of the consecutive pixels to a first delay unit, and the second pair of the next consecutive pixels a bypass block, based on first row/column ordinal information of the pixel pairs;

the DCC block for performing DCC transformation of the pixel pair received from the distribute by comparing the pixel pair of a current frame and the pixel pair of a previous frame;

the bypass block for delaying the second pair during the DCC transformation of the first pair;

a synthesizer for receiving outputs from the DCC block and the bypass block and selecting one of the outputs of the DCC block and the bypass block, based on the first row/column ordinal information of the pixel pairs to output transformed even data and transformed odd data;

a first row/column counter for counting the ordinals of the rows and columns of the pixel arrangement to provide the first row/column ordinal information to the distributor and the synthesizer;

the first delaying unit connected between the distributor and the synthesizer and delaying the second pixel data of the first pair during a predetermined time;

a first multiplexer for sequentially selecting and providing the first pixel data of the first pair to the DCC block and for receiving and outputting the delayed second pixel data of the first pair to the DCC block, based on second row/column ordinal information;

a second multiplexer for selecting one pixel data of the first pair outputted from the DCC block based on the second row/column ordinal information;

a second delaying unit connected between the DCC block and the synthesizer and delaying the pixel data outputted from the second multiplexer;

a second row/column counter counting the ordinals of the rows and the columns of the pixel arrangement to provide the second row/column ordinal information of each pair for the first and the second multiplexers;

first and second frame memories for storing the current frame data and the previous frame data, respectively; and a memory controller for storing the pixel data outputted from the first multiplexer in the first frame memory as the current frame data, and transmitting the previous frame data stored in the second frame memory to the DCC block.

11. The liquid crystal display of claim 10, wherein the first row/column counter every one or more rows of the pixel arrangement.

12. The liquid crystal display of claim 10, wherein the distributor and the synthesizer comprise third and fourth multiplexers, respectively.

13. A method of performing dynamic capacitance compensation(DCC) of pixels arranged in rows and columns in a liquid crystal display, comprising:

receiving pixel data of a current frame;

determining one of even pixel data and odd pixel data in each row as DCC-transforming pixel data based on row ordinal information of the pixels;

DCC-transforming the DCC-transforming data of the pixels of the current frame;

delaying DCC-untransforming data of the pixels of the current frame during a predetermined time; and synthesizing the DCC-transformed data and the delayed DCC-untransforming data to output transformed even pixel data and transformed odd pixel data, based on the row ordinal information, wherein determining one of even pixel data and odd pixel data in each row as DCC-transforming pixel data comprises determining the DCC-transforming pixel data such that a parity of the DCC-transforming pixel data is different from each other in row and column directions of the pixel arrangement.

14. A method of performing dynamic capacitance compensation (DCC) of pixels arranged in rows and columns in a liquid crystal display, comprising receiving pixel data of a current frame;

alternatively determining a pair of two consecutive pixels in each row as DCC-transforming pixel pair, based on row/column ordinal information of the pixel arrangement;

DCC-transforming one pixel data of the DCC-transforming pixel pair of the current frame whiling delaying the other pixel data of the DCC-transforming pixel pair;

delaying a next pair of the pixels during the application of DCC to the pixel data of the DCC-transforming pixel pair;

delaying the DCC-applied pixel data during DCC-transformation of the delayed pixel data of the DCC-transforming pixel pair; and synthesizing the DCC-transformed pixel pair and the delayed pixel pair as transformed even data and transformed odd data based on the row/column ordinal information of the pixel arrangement.

15. The method of claim 14, wherein DCC-transforming comprises comparing a gray value of the pixel data of the current frame with the gray value of the pixel data of a previous frame, and selecting corresponding transformed data from a look-up table based on a difference between the gray values of the current frame and the previous frame.

16. The method of claim 14, wherein alternatively determining a pair of two consecutive pixels in each row as DCC-transforming pixel pair comprises alternatively determining a pair of two consecutive pixels in each column as the DCC-transforming pixel pair.

17. The liquid crystal display of claim 1, wherein the DCC processing unit applies the dynamic capacitance compensation ("DCC") to only about half of all the pixels in a pixel row.

* * * * *